US005226263A

United States Patent [19]

Merrin et al.

[11] Patent Number: 5,226,263

[45] Date of Patent: Jul. 13, 1993

[54] WEATHER-TIGHT ROOF FLASHING SHIELD

[75] Inventors: William R. Merrin, San Jose; Dennis H. Gerber, Los Gatos, both of Calif.

[73] Assignee: Wil-Mar Products, Inc., San Jose, Calif.

[21] Appl. No.: 748,629

[22] Filed: Aug. 22, 1991

[51] Int. Cl.[5] ..... E04D 13/00

[52] U.S. Cl. ..... 52/58; 52/59; 52/60; 52/199; 285/43; 285/42

[58] Field of Search ..... 52/58, 59, 60, 94, 199; 285/42, 43, 44

[56] References Cited

U.S. PATENT DOCUMENTS

| | | | |
|---|---|---|---|
| 3,677,576 | 7/1972 | Gustafson | 285/43 |
| 4,010,578 | 3/1977 | Logsdon . | |
| 4,160,347 | 7/1979 | Logsdon . | |
| 4,512,119 | 4/1985 | Willoughby . | |

*Primary Examiner*—Carl D. Friedman
*Assistant Examiner*—Wynn Wood
*Attorney, Agent, or Firm*—Rosenblum, Parish & Isaacs

[57] ABSTRACT

An improved device for forming a weather-tight seal to a vent pipe and over a roof flashing. The device utilizes a high durability elastomeric material with a truncated conical shape and thickened upper lip to form a rain shed over the roof flashing, thereby ensuring a tight, durable seal to the vent pipe that prevents intrusion of moisture between the vent pipe and roof flashing.

16 Claims, 4 Drawing Sheets

WEATHER-TIGHT ROOF FLASHING SHIELD

BACKGROUND OF THE INVENTION

1. Field of the Invention

The present invention relates generally to roofing seals, and more particularly to an improved shield device for forming a permanent weather-tight seal to a vent pipe and over a roof flashing.

2. Brief Description of the Prior Art

A number of specialized devices have been developed over the years to form a seal between a roof and a pipe projecting through that roof. These include roof flashing devices having a flat plate with a centralized, upwardly projecting, tapered housing with an opening. The flat plate is attached to the roof, and the vent pipe passes through the opening in the tapered housing. The housing and the pipe are often sealed with a caulking or other mastic-like material.

The prior art teaches several roof flashing structures which use a sealing ring to attempt to create a more permanent, weather-proof seal. For example, Gustafson (U.S. Pat. No. 3,677,576) and Logsdon (U.S. Pat. Nos. 4,010,578 and 4,160,347) disclose roof flashing structures which integrally include an elastomeric sealing member for forming a better seal between the vent pipe and the roof. Willoughby (U.S. Pat. No. 4,512,119) teaches another way to seal a roof flashing to a pipe, with an annular rubber washer and a neoprene weather apron.

Independent seals, which are not integrally included with a roof flashing structure, are also known in the prior art. The prior art independent seal products are not part of a flashing structure which provides support. Therefore, they have used relatively rigid plastic material. Such devices are forced down over the vent pipes. A series of annular sealing rings on the inner surface of the seal device engage the vent pipe to form a series of seals.

Roof flashing sealing devices are subject to considerable stress. When the ambient temperature rises and falls, both a building and a vent pipe extending through a roof will expand and contract. These expansions and contractions with varying temperature do not occur at the same rate. Thus, the building roof and the vent pipe will move upward or downward by different amounts with a given temperature variance. The device used to seal a vent pipe to a roof flashing is subject to these movements.

The prior art roof flashing devices with elastomeric seals have several disadvantages related to these movements. The upward and downward cycling of the sealing device reduces the effectiveness of the seal. Roof flashing devices which include an integral elastomeric sealing member can invert under certain conditions. Once inversion occurs, water can accumulate in the inverted seal, and the combination of sunlight on the inverted seal and water sitting in the seal cause the sealing member to decompose. Roof flashing devices with an integral sealing member also are significantly more expensive than independent seal products.

The prior art independent seals also have a number of disadvantages. These problems begin at the time the seals are applied. Since they are composed of relatively rigid plastic, they must be hammered onto the vent pipe. Thus, their application could lead to cracking and crazing. The use of relatively rigid plastic also prevents the seal from conforming to the vent pipe; the hard material will bridge any discontinuity in the pipe.

As with the combination roof flashing/elastomeric seal devices, the effectiveness of independent sealing devices is also reduced by the upward and downward cycling of the sealing device with temperature variation. The relatively rigid seals of the prior art do not slide up and down with thermal expansion and contraction. Instead, the rigid seal becomes distorted and does not conform to the vent pipe that it surrounds. Prior art independent seals which use a series of relatively narrow seals may quickly lose their effectiveness with thermal cycling. Moreover, the rigid independent seals of the prior art are susceptible to cold-flow and creep, which makes the distortion problem worse. This failure to conform to the vent pipe causes stress in the seal, leading to faster aging of the seal.

Neither the integral roof flashing/elastomeric seal nor the relatively rigid independent seal tolerates contamination on a vent pipe (such as paint, cement, or glue) very well. In addition, neither works well when a roof has two vent pipes close together. In the past, these situations have generally been handled with a "pitch pan", where a pan is filled with a filler such as mastic, foam, or concrete, and covered with asphalt or another sealer.

SUMMARY OF THE INVENTION

It is an object of this invention to provide an improved roofing shield for forming a permanent weather tight seal to a vent pipe and over a roof flashing. It is a further object of this invention to provide a roofing shield which may be applied by hand, without the need to force the shield with a hammer or to apply the shield with special tools.

It is another object of this invention to provide an improved roofing shield which will conform to any discontinuities in a vent pipe to eliminate any leaks. A further object of this invention is to create a roofing shield with sufficient elasticity that it may be used on roofs of all different pitches, and with multiple, closely spaced vent pipes.

It is still another object of the invention to provide an improved roofing shield which is not susceptible to creep or cold flow under stress, and which maintains a complete seal through thermal expansion and contraction cycling.

A further object of this invention is to minimize the inventory of roofing seals and shields required by shops and roofers, through a greater range of adaptability in the sizes of vent pipes which roofing shields of a given size will accommodate.

Another object of this invention is to reduce the cost of these roofing shields through use of a design that is easier and less expensive to manufacture, and through use of a material lo with a long life and low cost.

These and related objects may be achieved through the use of the preferred embodiment of the improved roofing shield disclosed below. Briefly, the preferred embodiment of this invention comprises a roofing shield in the shape of a truncated cone, composed of a high durability elastomeric material. The shield utilizes a thickened upper sealing lip and slightly curved lower edge. Use of a shield as described in the preferred embodiment allows the shield to be easily installed by hand, and ensures that the sealing lip will conform to any discontinuities in the vent pipe. In addition, the shield when applied also covers the open top edge of the underlying roof flashing. Thus, a weather-tight seal is formed to the vent pipe, and a rain shed effect prevents water from entering through the open top edge of the roof flashing.

In the preferred embodiment, the shield also is not subject to creep under stress, and has sufficient elasticity to continue to form a tight seal and rain shed effect with thermal cycling or other relative movement of the roof flashing and vent pipe. The preferred embodiment is capable of retaining a complete seal and rain shed effect under such conditions over time. The elasticity of the preferred embodiment permits the shields to be used on roofs on any pitch, and also permits use of the shields on closely-spaced multiple vent pipes. In addition, the preferred embodiment reduces the inventory requirements for roofing seals and shields, because of the greater range of adaptability in size of shields manufactured in accordance with the invention.

The preferred embodiment may be manufactured inexpensively using a low-cost elastomeric material. The shape of the preferred embodiment permits efficient manufacturing, because demolding of the shield is simpler than demolding of the prior art independent seal products.

The attainment of the foregoing and related objects, advantages and features of the invention should be more readily apparent to those skilled in the art after review of the following more detailed description of the invention.

BRIEF DESCRIPTION OF THE DRAWINGS

FIG. 2(*b*) is a cross-section taken along line A—A of FIG. 1 and FIG. 2(*a*);

DETAILED DESCRIPTION OF THE PREFERRED EMBODIMENT

Figure 1:
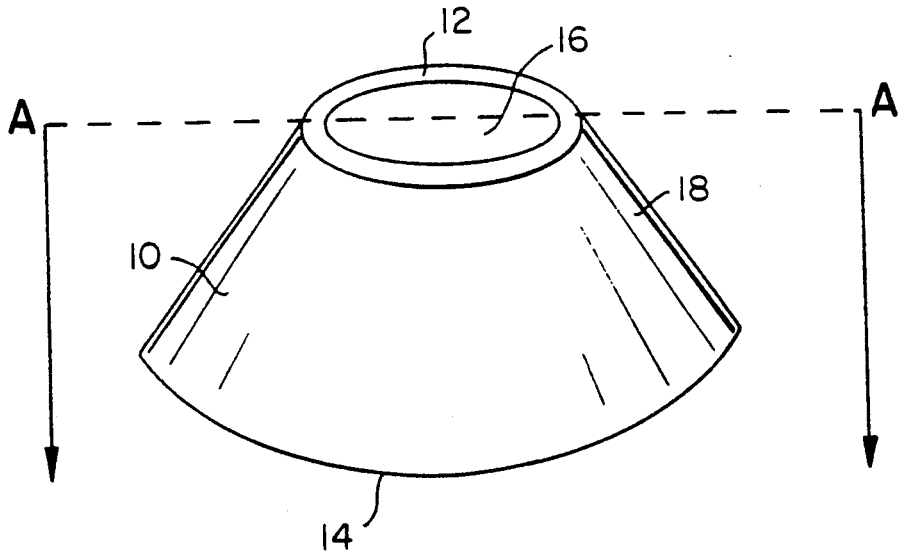
FIG. 1 is a perspective view of the preferred embodiment of the improved roofing shield of this invention.

This invention constitutes an improved roofing shield for forming a permanent weather-tight seal to a vent pipe and over a roof flashing. With reference to FIG. 1, a roof shield in accordance with the invention is illustrated. Shield 10 has a truncated conical shape, with an upper sealing lip 12 and lower edge 14. Opening 16 permits a vent pipe to be passed through shield 10.

Figure 2A:
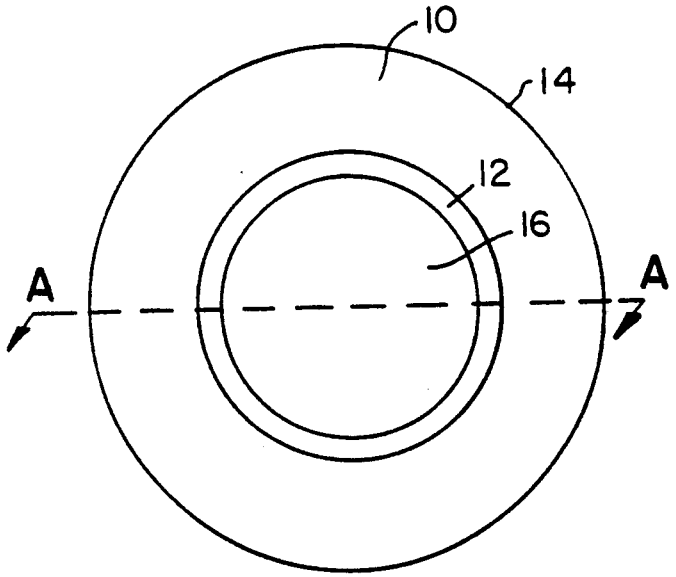
FIG. 2(*a*) is a top view of the roofing shield.
Figure 2B:
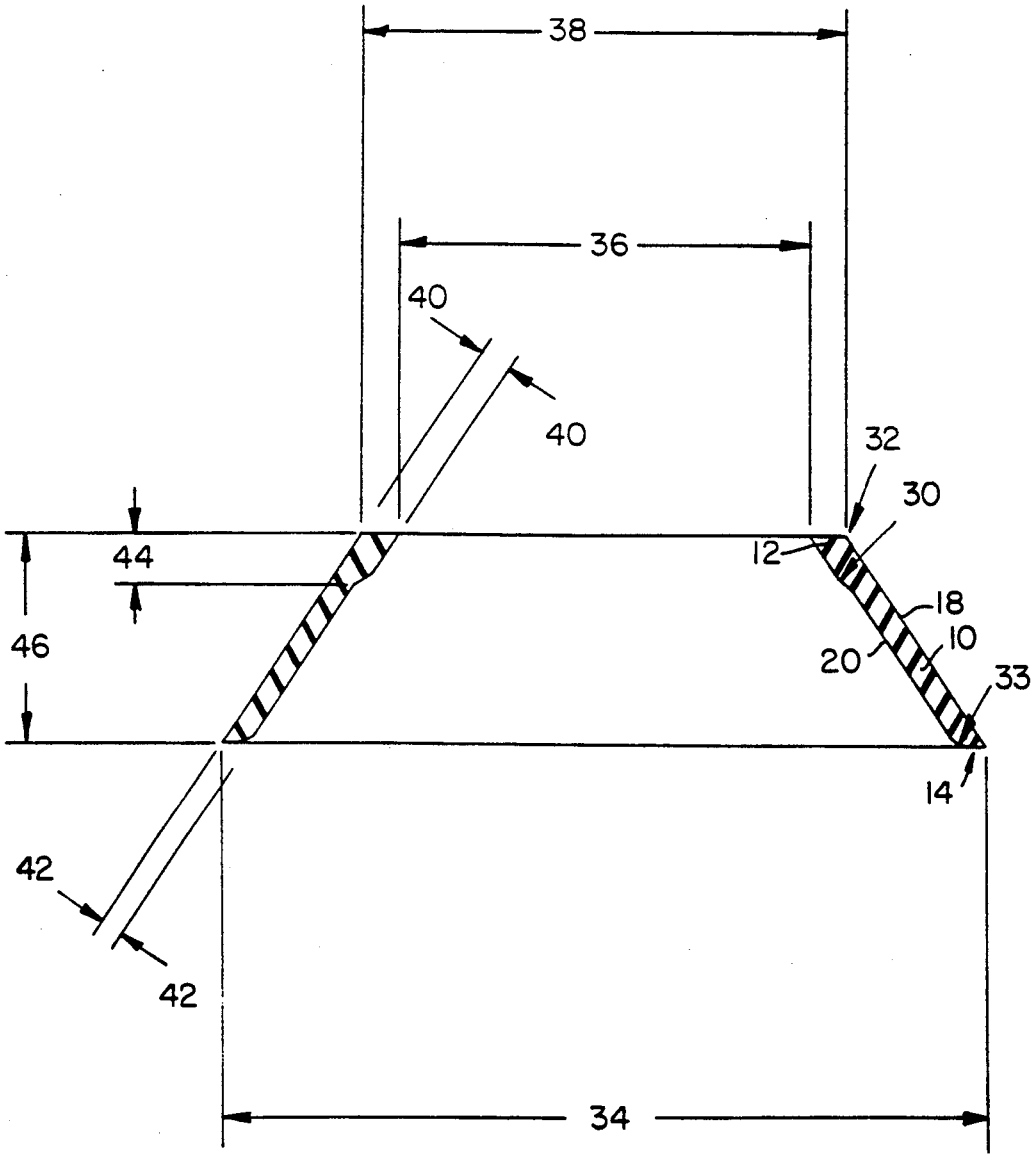

Referring now to FIG. 2(*a*), a top view of shield 10 is shown. FIG. 2(*b*) shows a vertical cross-section of shield 10 taken along line A—A of FIG. 1 and FIG. 2(*a*). Table 1 indicates the preferred dimensions for shield 10 for use with pipes of different inner diameters.

TABLE 1

Dimensions of Shields for Different Pipes (Inches)

| Pipe Size | | | | Shield Dimensions | | | |
|---|---|---|---|---|---|---|---|
| | | | | O.D. | Wall | Lip | |
| I.D. | O.D. | Lip I.D. | Lip. O.D. | Lower Edge | Thick-ness | Thick-ness | Lip Height |
| 0.50 | 0.84 | 0.700 | 1.071 | 2.44 | 0.125 | 0.166 | 0.253 |

TABLE 1-continued

Dimensions of Shields for Different Pipes (Inches)

| Pipe Size | | | | Shield Dimensions | | | |
|---|---|---|---|---|---|---|---|
| | | | | O.D. | Wall | Lip | |
| I.D. | O.D. | Lip I.D. | Lip. O.D. | Lower Edge | Thick-ness | Thick-ness | Lip Height |
| 0.75 | 1.05 | 0.900 | 1.278 | 2.65 | 0.125 | 0.165 | 0.231 |
| 1.00 | 1.32 | 1.170 | 1.550 | 2.91 | 0.125 | 0.165 | 0.201 |
| 1.25 | 1.66 | 1.465 | 1.855 | 3.26 | 0.125 | 0.165 | 0.191 |
| 1.50 | 1.90 | 1.680 | 2.070 | 3.50 | 0.125 | 0.165 | 0.249 |
| 2.00 | 2.38 | 2.110 | 2.500 | 3.98 | 0.125 | 0.165 | 0.280 |
| 3.00 | 3.50 | 3.090 | 3.500 | 5.10 | 0.125 | 0.165 | 0.352 |
| 4.00 | 4.50 | 3.970 | 4.390 | 6.10 | 0.125 | 0.172 | 0.422 |

Shield 10 has outer wall 18 and inner wall 20. The wall thickness 42 between outer wall 18 and inner wall 20 below the lip region is preferably about 0.125 inches. Upper sealing lip 12 preferably has a lip thickness 40 of approximately 0.16 to 0.17 inches. The outer surface 32 of upper lip 12 is rounded, with a preferred radius of 0.125 inches. Inner surface 30 of upper lip 12 is also rounded in the transition area between wall thickness 42 and lip thickness 40, with a preferred radius of approximately 0.188 inches. As Table 1 indicates, lip height 44 is preferably in the range of 0.19 to 0.26 inches for shields designed to fit pipes with inner diameters of between 0.50 to 1.50 inches, and increases for pipes with greater diameters. Table 1 also shows how lip outer diameter 38 and lip inner diameter 36 increase for pipes with greater diameters. The difference between lip outer diameter 38 and lip inner diameter 36 is approximately 0.37 to 0.44 inches, increasing slightly for pipes of greater diameter.

Shield 10 preferably has a height 46 of approximately 1.12 inches. Lower edge 14 has a rounded inner surface 33, with a preferred radius in the range of 0.125 to 0.25 inches. The outer diameter 34 of shield 10 at lower edge 14 is sufficiently large that an adequate rain shed effect is created. For shields designed to fit pipes with an inner diameter of 0.50 to 3.0 inches, the outer diameter 34 at the lower edge 14 is approximately 1.3 to 1.6 inches greater than the outer diameter 38 at upper lip 12. For pipes of greater diameter, the difference between distances 34 and 38 is greater, in order to ensure that lower edge 14 of shield outer wall 18 is sufficiently far from the larger vent pipe and roof flashing to prevent intrusion of moisture, as discussed below with reference to FIG. 4. The angles formed between a vertical line from the outer edge of upper lip 14 and outer wall 18 are given in Table 2 for the preferred embodiments of shields for use with pipes of different sizes.

TABLE 2

Angle Formed Between Edge of Upper Lip of Shield and Shield Outer Wall

| Shield for Pipe Having I.D. (Inches) | Angle Between Upper Lip and Outer Wall (Degrees) |
|---|---|
| 0.50 | 31 |
| 0.75 | 31 |
| 1.00 | 31 |
| 1.25 | 32 |
| 1.50 | 33 |
| 2.00 | 33 |
| 3.00 | 36 |
| 4.00 | 44 |

The shield is composed of a resilient elastomeric material; one preferred form is ethylene propylene diene monomer (EPDM). EPDM has the advantages that it is relatively low cost, is sufficiently elastic that a seal of a particular size may be used with a relatively broad range of pipe diameters, and is not susceptible to the creep or cold flow problems of more rigid materials. This later property permits the seal to retain a complete seal despite thermal cycling. A second preferred form is silicon rubber, which is adaptably suitable for high temperature applications.

Figure 3A:
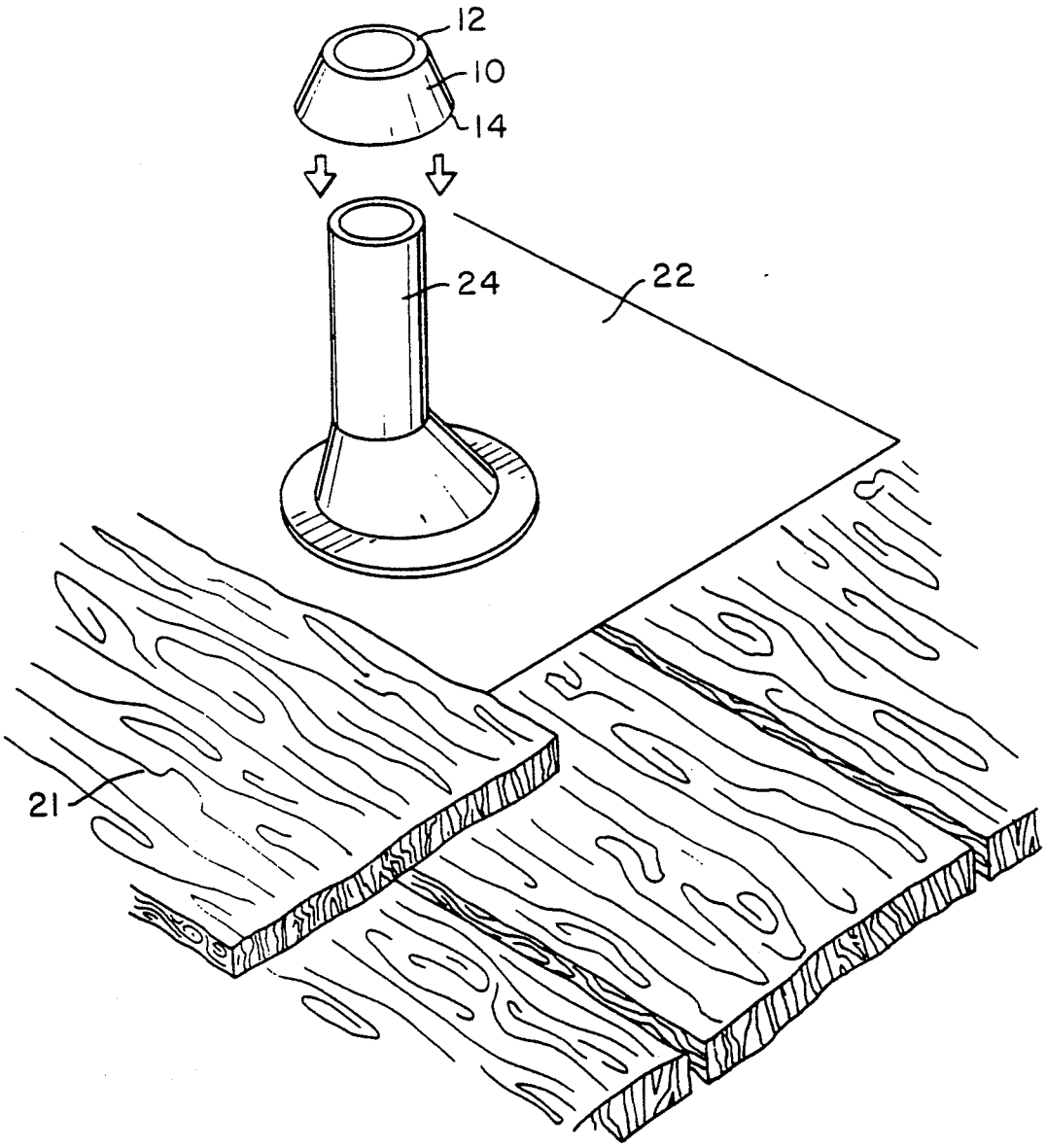
FIGS. 3(*a*) and 3(*b*) are perspective views of the preferred embodiment of the invention, showing application of the shield to seal a vent pipe and a roof flashing.
Figure 3B:
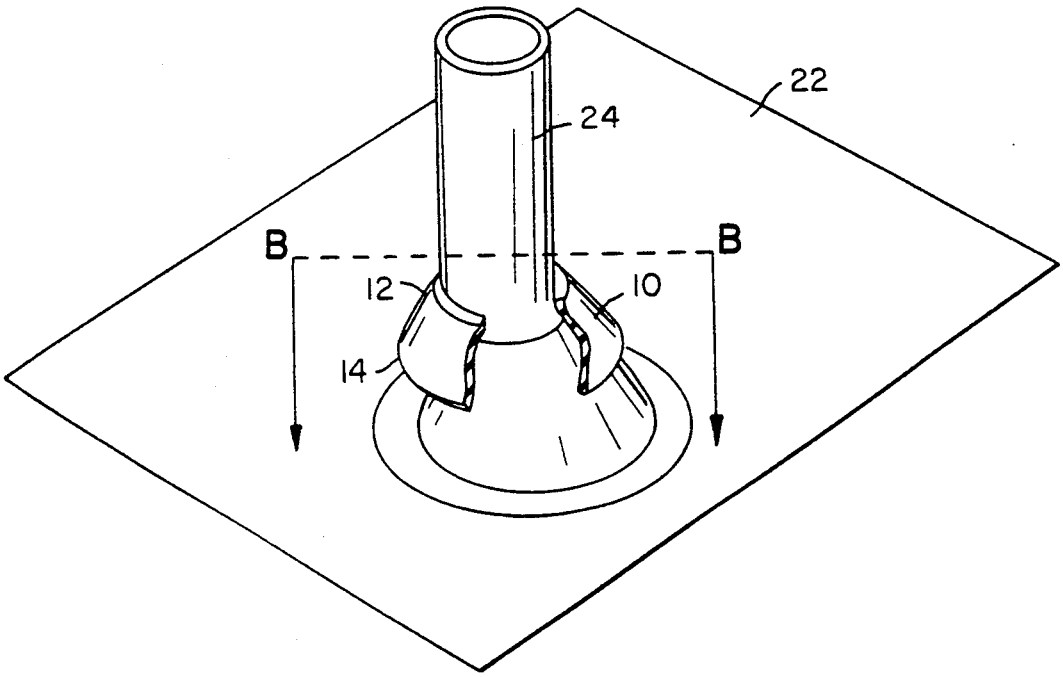

With reference to FIG. 3(*a*) and FIG. 3(*b*), perspective views of shield 10 being applied and as applied are shown. FIG. 3(*a*) shows a portion of roof with shingles 21, and roof flashing 22 with a conical opening through which vent pipe 24 passes. Shield 10 is about to be applied. FIG. 3(*b*) shows that upper lip 12 of shield 10 forms a seal to vent pipe 24, and shield 10 forms a rain shed over roof flashing 22.

Figure 4:
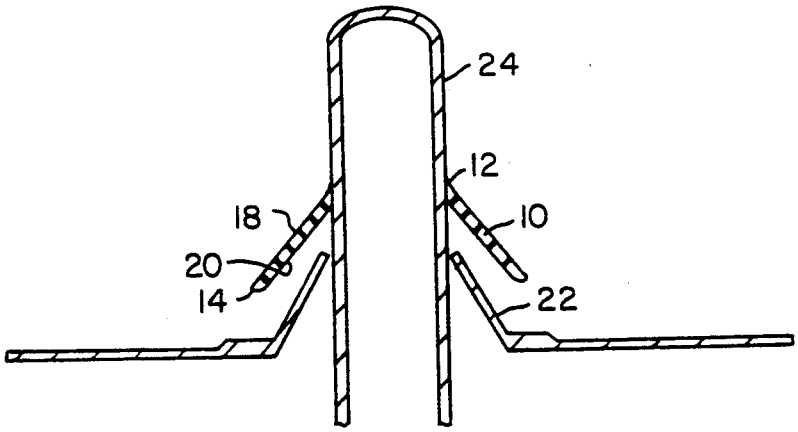
FIG. 4 is a cross-sectional view of the preferred embodiment as applied, taken along line B—B of FIG. 3(*b*).

FIG. 4 is a cross-sectional view taken along line B—B of FIG. 3(*b*). Since shield 10 is composed of a resilient elastomeric material, it may be installed by hand over vent pipe 24. This ease of installation is a major advantage over the relatively rigid seals of the prior art. When shield 10 is applied as shown in FIG. 3(*b*) and FIG. 4, upper lip 12 elongates. Table 3 shows the typical elongations for shields designed to fit pipes with differing sizes.

TABLE 3

| TYPICAL SHIELD ELONGATION (Dimensions in Inches) | | | |
|---|---|---|---|
| Pipe Size | Pipe Outer Diameter | Shield Inner Diameter (as molded) | % Elongation |
| 0.50 | 0.84 | 0.70 | 20.0% |
| 0.75 | 1.05 | 0.90 | 16.7% |
| 1.00 | 1.32 | 1.17 | 12.8% |
| 1.25 | 1.66 | 1.465 | 13.3% |
| 1.50 | 1.90 | 1.68 | 13.1% |
| 2.00 | 2.38 | 2.11 | 12.8% |
| 3.00 | 3.50 | 3.10 | 12.9% |
| 4.00 | 4.50 | 3.98 | 13.0% |

The range of elongation of the shields is generally between 1% and 20%, with the preferred range between 12% and 17%. Thus, a shield as described in this disclosure may accommodate pipes within a range of outer diameters. This lowers the inventory of seals required by shops and roofers.

Outer wall 18 extends sufficiently far from the opening of roof flashing 22 that moisture runs off vent pipe 24 and shield 10 without entering the opening of roof flashing 22. In addition, as discussed above in reference to FIG. 2(*b*), lower edge 14 has a rounded inner surface 33. As FIG. 4 shows, use of this rounded surface prevents capillary action of moisture along lower edge 14, thus preventing moisture from passing down shield outer wall 18 and upward by capillary action along inner wall 20, which would permit moisture to reach the opening between roof flashing 22 and vent pipe 24.

FIG. 4 also shows several other features of the preferred embodiment. Since upper lip 12 is relatively long in comparison with prior art seals, when it is applied it forms a longer and surer sealing surface with vent pipe 24. The elasticity of shield 10 ensures that upper lip 12 conforms to the pipe, and the longer seal formed by upper lip 12 ensures that discontinuities in the vent pipe 24, or contaminants upon the vent pipe 24 (such as cement or glue), do not create leaks.

FIG. 4 demonstrates how lower edge 14 creates a moisture-deflecting shield over the roof flashing 22 below. Because shield 10 does not seal to flashing 22, it allows for relative movement contraction between vent pipe 24 and roof flashing 22, (as may happen due to thermal expansion and contraction), while still maintaining a weather tight seal.

The elasticity of shield 10 also permits it to be used on roofs of all pitches, unlike relatively rigid prior art seals which cannot tolerate roofs of high pitches. In addition, this elasticity permits the shields of this invention to be used on closely spaced vent pipes (one shield to a pipe), because the shields may be highly deformed while still maintaining a complete seal to a vent pipe. This obviates the need for the more labor intensive and costly "pitch pan" sealing method previously used. The elasticity also ensures that during thermal cycling, the seal formed by contact of upper lip 12 with vent pipe 24 moves up and down as vent pipe 24 moves due to thermal cycling. During this upward and downward movement, the rain deflective shield created by lower edge 14 over roof flashing 22 continues to prevent intrusion of moisture.

Manufacture of shield 10 is simplified over the multiple sealing surfaces used in prior art independent seals. Since shield 10 uses a thickened upper lip 12 to form a single elongated seal, rather than a series of smaller sealing edges, demolding of shield 10 is simpler than demolding seals with multiple sealing edges. This is because multiple sealing edges tend to enlock the part in the mold.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A vent pipe that passes through a hole in a roof flashing and an independent shield for forming a permanent weather-tight seal to said vent pipe, wherein said shield is comprised of resilient ethylene propylene diene monomer formed to have a hollow truncated conical shape defining a central opening through which said vent pipe passes, said shield having a thickened sealing lip at the upper edge of said shield and a wall extending below said sealing lip, said wall being thinner than said sealing lip and terminating in a lower edge, wherein said sealing lip elongates in the axial direction of said conical shape when said shield is resiliently applied over said vent pipe thereby forming a single weather-tight seal to said vent pipe through compressive attachment of said sealing lip to said vent pipe, and wherein the diameter of said shield at said lower edge exceeds the diameter of the hole in said roof flashing and is not intended to engage said roof flashing, said shield being adapted to form a skirt covering and extending over said roof flashing so as to deflect moisture away from said opening, said shield being movable with said vent pipe independent of said roof flashing during thermal expansion and contraction of said vent pipe, thereby preventing the entrance of moisture through said hole.

2. The shield of claim 1 wherein said lower edge tapers upward to the inner surface of said wall, thereby preventing capillary movement of moisture upward along said inner surface.

3. The shield of claim 1 wherein said sealing lip has a lip thickness of from 0.15 to 0.20 inches and said wall has a wall thickness of from 0.10 to 0.14 inches.

4. The shield of claim 3 wherein said sealing lip and a transition area between said sealing lip and said wall have a height of from 0.20 to 0.50 inches.

5. The shield of claim 4 wherein the elongation of said sealing lip when applied over a vent pipe is from 5% to 30%.

6. The shield of claim 4 wherein the angle between the outer edge of said sealing lip and the outer surface of said wall is constant throughout the length of said wall.

7. The shield of claim 6 wherein said angle is from 25 to 50 degrees.

8. The shield of claim 7 wherein said lower edge tapers upward to the inner surface of said wall, thereby preventing capillary movement of moisture upward along said inner surface.

9. A vent pipe that passes through a hole in a roof flashing and an independent shield for forming a permanent weather-tight seal to said vent pipe, wherein said shield is comprised of resilient silicon rubber formed to have a hollow truncated conical shape defining a central opening through which said vent pipe passes, said shield having a thickened sealing lip at the upper edge of said shield and a wall extending below said sealing lip, said wall being thinner than said sealing lip and terminating in a lower edge, wherein said sealing lip elongates in the axial direction of said conical shape when said shield is resiliently applied over said vent pipe thereby forming a single weather-tight seal to said vent pipe through compressive attachment of said sealing lip to said vent pipe, and wherein the diameter of said shield at said lower edge exceeds the diameter of the hole in said roof flashing and is not intended to engage said roof flashing, said shield being adapted to form a skirt covering and extending over said roof flashing so as to deflect moisture away from said opening, said shield being movable with said vent pipe independent of said roof flashing during thermal expansion and contraction of said vent pipe, thereby preventing the entrance of moisture through said hole.

10. The shield of claim 9 wherein said lower edge tapers upward to the inner surface of said wall, thereby preventing capillary movement of moisture upward along said inner surface.

11. The shield of claim 9 wherein said sealing lip has a lip thickness of from 0.15 to 0.20 inches and said wall has a wall thickness of from 0.10 to 0.14 inches.

12. The shield of claim 11 wherein said sealing lip and a transition area between said sealing lip and said wall have a height of from 0.20 to 0.50 inches.

13. The shield of claim 12 wherein the elongation of said sealing lip when applied over a vent pipe is from 5% to 30%.

14. The shield of claim 12 wherein the angle between the outer edge of said sealing lip and the outer surface of said wall is constant throughout the length of said wall.

15. The shield of claim 14 wherein said angle is from 25 to 50 degrees.

16. The shield of claim 15 wherein said lower edge tapers upward to the inner surface of said wall, thereby preventing capillary movement of moisture upward along said inner surface.

* * * * *